United States Patent [19]

Blevins et al.

[11] Patent Number: 4,509,216

[45] Date of Patent: Apr. 9, 1985

[54] SOFA BED MECHANISM

[75] Inventors: Theodore J. Blevins; Paul R. Swiderski, both of Georgetown, Ky.

[73] Assignee: Hoover Universal, Inc., Ann Arbor, Mich.

[21] Appl. No.: 444,942

[22] Filed: Nov. 29, 1982

[51] Int. Cl.[3] ..... A47C 17/04; A47C 17/00

[52] U.S. Cl. ..... 5/13; 5/14; 5/51 K

[58] Field of Search ..... 5/13, 14, 28, 29, 51 G, 5/51 J, 51 K; 248/421, 584–591; 292/113

[56] References Cited

U.S. PATENT DOCUMENTS

| | | | |
|---|---|---|---|
| 2,712,955 | 7/1955 | Andrews | 292/113 |
| 3,380,083 | 4/1968 | Mikos | 5/13 |
| 3,694,828 | 10/1972 | Mikos et al. | 5/13 |
| 4,004,305 | 1/1977 | Rubin | 5/13 |
| 4,045,063 | 8/1977 | Fletcher et al. | 292/110 |
| 4,139,917 | 2/1979 | Fenwick | 5/465 |
| 4,220,364 | 9/1980 | Poe | 292/113 |
| 4,399,571 | 8/1983 | Joyce | 5/13 |

FOREIGN PATENT DOCUMENTS

| | | | |
|---|---|---|---|
| 173715 | 9/1975 | Canada | 292/26 |

*Primary Examiner*—Alexander Grosz
*Assistant Examiner*—Vinh Luong
*Attorney, Agent, or Firm*—Stephenson and Boller

[57] ABSTRACT

In a sofa bed mechanism which includes a foldable bed frame, a support member on which the bed frame is movably supported, a linkage assembly operable to govern movement of the bed frame and a control member for guiding movement of the mechanism into and out of a storage position in a supporting framework.

4 Claims, 6 Drawing Figures

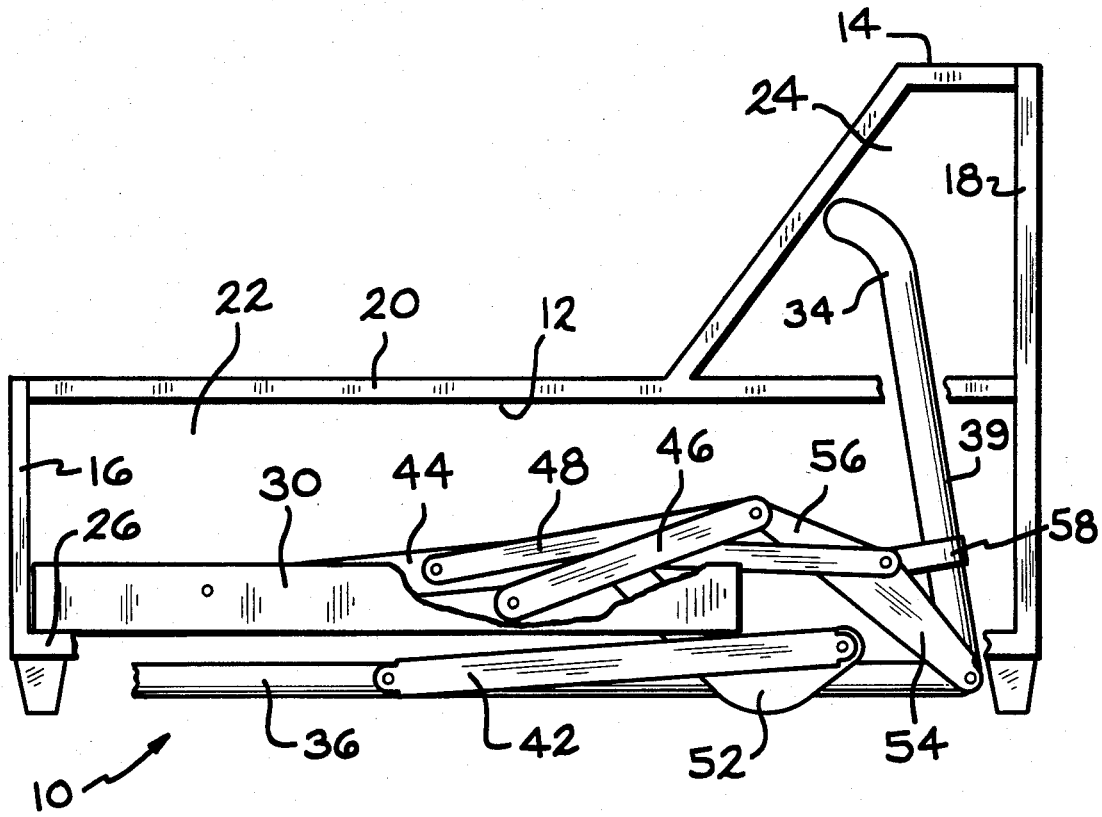
FIG. 4
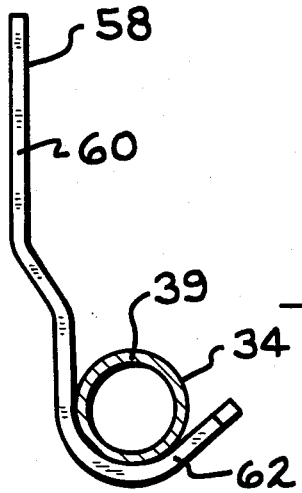
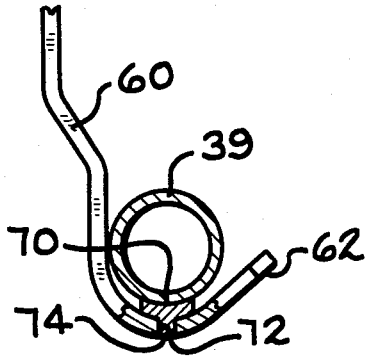
FIG. 6
FIG. 5

SOFA BED MECHANISM

BACKGROUND OF THE INVENTION

This invention relates to sofa bed mechanisms of the type in which a foldable bed frame is mounted within a sofa frame for movement between a horizontal bed position and a folded sofa position in which the bed frame is stored within the sofa frame. The objectives of such mechanisms include compactness in the sofa position, sleeper comfort in the bed position, simplicity of design and operation, and minimization of cost and weight.

Many conventional sofa frames have front, back and side frame members which define a storage space which includes a vertically elongated portion adjacent the back frame member. In order to achieve the aforementioned objective of compactness in the sofa position, it is desirable to utilize the elongated portion of the storage space in storing the bed frame. In particular, in sofa bed mechanisms wherein the bed frame comprises a head section, an intermediate section, and a foot section, it has been found desirable to store the head section within the vertically elongated portion of the storage space. Consequently, it is an object of the present invention to provide a sofa bed mechanism comprising a bed frame with a head section wherein the head section can be stored within the vertically elongated portion of the storage space in a sofa frame of the type previously mentioned.

Another object of this invention is to provide a means for moving the head section of a sofa bed frame into a vertically elongated storage space which does not interfere with sleeper comfort in the bed position, does not add to the outside dimension of the bed frame, and is lightweight, inexpensive and simple to install and operate.

SUMMARY OF THE INVENTION

The sofa bed mechanism of this invention can be produced integrally with a sofa frame, or it can be produced independently and installed separately. Although the invention is not limited to sofa frames of any particular type, the invention is particularly well adapted for use in sofa frames wherein the front, back and side frame members define a storage space which includes a vertically elongated section adjacent the back frame member.

The mechanism of this invention includes a support member which can be supported on the sofa frame or adapted to be supported on the floor and secured to the sofa frame to prevent movement relative thereto. A bed frame is supported on the support member and comprises in succession a head section, an intermediate section and a foot section. The head and foot sections are pivotally connected to the intermediate section, and the bed frame is movable between an unfolded bed position, in which the sections are coplanar and provide a substantially horizontal deck, and a folded sofa position in which the bed frame is completely received within the sofa frame storage space. In the sofa position, the foot section is folded onto the intermediate section, the intermediate section extends substantially parallel to and adjacent the support member and the head section extends substantially upwardly from the intermediate section. The mechanism also includes a plurality of legs which extend between the bed frame and the floor when the bed frame is in the unfolded bed position. The legs are adapted to be folded into a compact relationship with the bed frame when the bed frame is folded and moved to the sofa position. A linkage assembly is provided to govern movement of the bed frame between its folded and unfolded positions.

The invention further includes a head section control member whose function is to guide movement of the head section when the bed frame is moved toward its folded sofa position. The head section control member comprises a flange secured to the linkage assembly and engagement means on the flange adapted to underlie a portion of the head section of the bed frame. When the bed frame is folded, the head section engages the head section control member which pivots the head section upwardly relative to the intermediate section and guides the head section into the vertically elongated portion of the sofa frame storage space. Conversely, when the bed frame is unfolded, the head section becomes disengaged from the head section control member and moves back into coplanar alignment with the intermediate section.

The invention thus provides an improved sofa bed mechanism which is foldable into an extremely compact unit, which therefore permits wide latitude in the design and construction of sofa bed frames. The invention provides a head section control member which, when the bed frame is folded, guides the head section into the vertically elongated portion of the sofa frame storage space. The head section control member is simple, lightweight and inexpensive. It does not include any cross tubes which would interfere with sleeper comfort in the unfolded bed position and would add to the overall dimensions of the bed frame.

BRIEF DESCRIPTION OF THE DRAWINGS

FIGS. 2–4, inclusive, are foreshortened side views of the mechanism of this invention shown in assembled relation with a sofa frame, and showing successive positions of the bed frame as it moves from its unfolded bed position to its folded sofa position;

FIG. 5 is a transverse sectional view of the head section of the bed frame, as seen from substantially the line 5—5 in FIG. 2, showing the head section control member in engagement therewith; and FIG. 6 is a view like FIG. 5 of a modified control member provided with a spacer.

DETAILED DESCRIPTION OF THE PREFERRED EMBODIMENT

Figure 2:
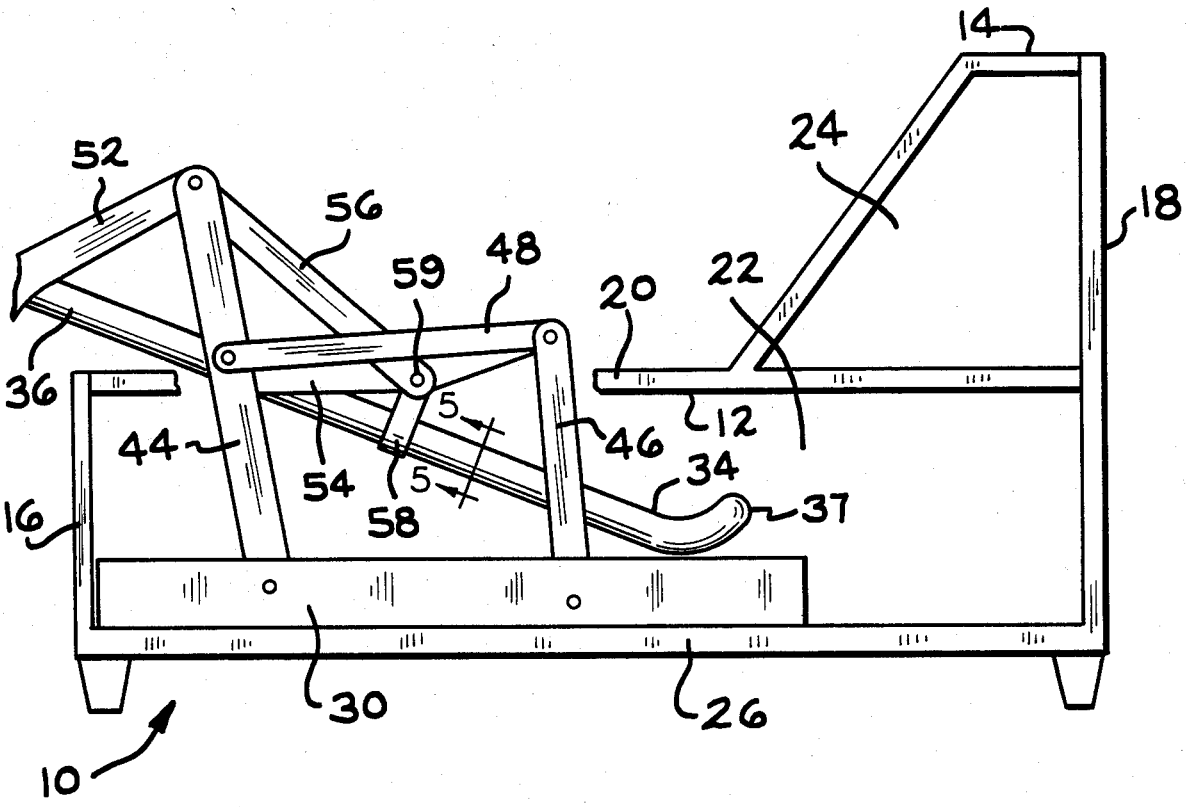
Figure 3:
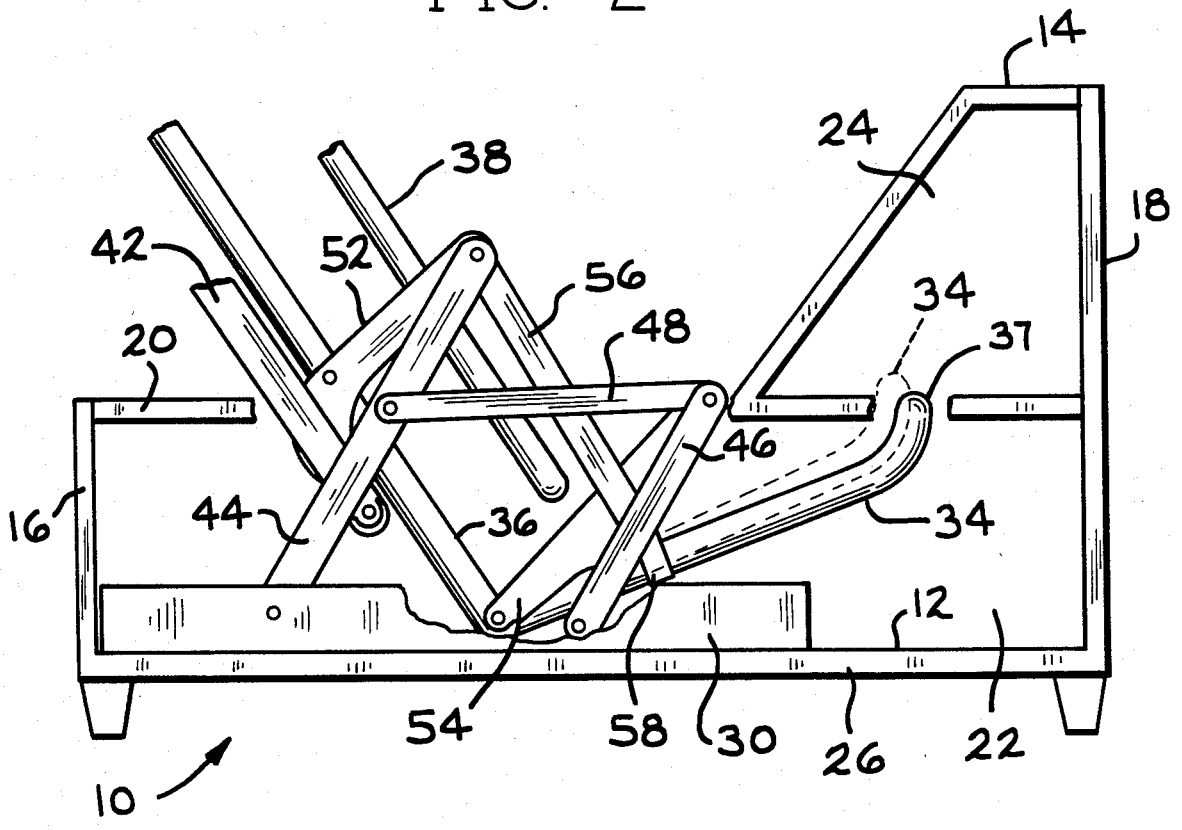

With reference to the drawings, the sofa bed mechanism of this invention, indicated generally at 10, is illustrated in FIG. 4 in its folded sofa position in which it is received completely within the storage space 12 of a sofa frame 14. Conventional sofa frames of the type shown in FIG. 4 typically include front, back and side frame sections 16, 18 and 20, respectively, which define the storage space 12 so that it includes a lower portion 22 and a vertically elongated portion 24 adjacent the back wall 18. The mechanism 10 can be supported on a bottom frame member 26 of the sofa frame 14, as seen in FIGS. 2–4, or it can be floor-supported and separately attached to the sofa frame 14 to prevent relative movement of the mechanism 10 and the frame 14.

Figure 1:
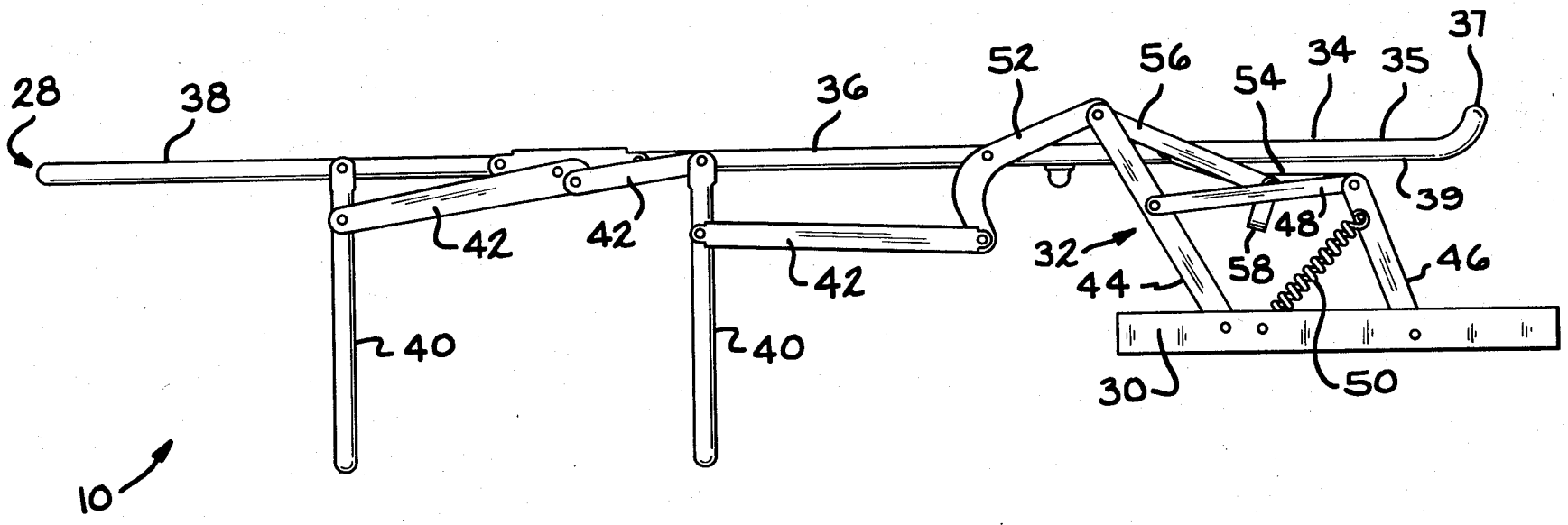
FIG. 1 is a side view of the sofa bed mechanism of this invention, showing the mechanism in its unfolded bed position.

With reference now to FIG. 1, the mechanism 10 comprises a bed frame, indicated generally at 28, supported on a support member 30 and movable by means of a linkage assembly, indicated generally at 32, between the unfolded bed position shown in FIG. 1 and the folded sofa position shown in FIG. 4. The bed frame 28 includes a head section 34, an intermediate section 36, and a foot section 38 which are pivotally connected at their ends so that the sections are relatively movable. When the frame 28 is in its unfolded bed position, as seen in FIG. 1, the sections 34, 36 and 38 are aligned in a substantially horizontal coplanar relationship. When the bed frame 28 is in its sofa position, as seen in FIG. 4, the foot section 38 is folded onto the intermediate section 36, the foot and intermediate sections 38 and 36 extend substantially parallel to the support member 30, and the head section 34 is pivoted substantially upwardly relative to the intermediate section 36. A pair of legs 40 are pivotally supported on the bed frame 28 and extend between the bed frame 28 and the floor to provide support for the bed frame in the unfolded position. Links 42 are also provided on the legs 40 and the frame 28 so that when the bed frame 28 is folded, the legs 40 are moved to positions substantially parallel to and adjacent the frame sections 36 and 38 so that the mechanism 10 can be stored within a minimum of space.

The linkage assembly 32 includes first and second support links 44 and 46 which are pivotally connected to the support member 30 and a cross link 48 which is pivotally secured at one end to the free end of the second support member 46 and at the other end to the midsection of the first support link 44. A spring 50 extending between the support member 30 and the second support link 46 urges the link 46 to pivot in a counterclockwise direction, as seen in FIG. 1, to facilitate unfolding of the bed frame 28 and provide added stability in the unfolded position. A lever 52 which is secured at its midsection to the intermediate section 36 of the bed frame 28 has one end which is pivotally secured to the free end of the support link 44 and the other end secured to the link 42 associated with one of the legs 40. The lever 52 controls movement of the intermediate section 36 and the leg 40 during folding and unfolding of the bed frame 28. The linkage assembly 32 also includes a control arm 54 having one end secured at the juncture of the link 46 and the cross link 48 and the other end secured at the connection between the head section 34 and the intermediate section 36. A restraining link 56 extends between the connection of the support link 44 and the connecting arm 52 and the midsection of the control arm 54.

In practice, it will usually be found desirable to provide a linkage assembly 32 at each side of the bed frame 28. Each of the components comprising the linkage assembly 32 is positioned completely to the side of the bed frame 28 so as not to interfere with sleeper comfort.

The head section 34 of the bed frame 28 consists of a tube 35 shaped to form an end portion 37 and a pair of side tubes 39, only one of which is shown in FIG. 1. The mechanism 10 further includes a head section control member 58 which is pivotally connected to the linkage assembly 32 by a pivot member 59 at the junction of the restraining link 56 and the control arm 54. In practice, it will be expedient to employ two head section control members 58, each of the members 58 being associated with one of the side tubes 39 of the head section 34. As seen in FIG. 5, the head section control member 58 comprises a bracket member consisting of a body 60 which ordinarily hangs downwardly from the pivot member 59 on the control arm 54. The body 60 terminates at its lower end in a laterally extending flange portion 62 which extends inwardly of the bed frame 28 so as to substantially underlie the side tube 39. As seen in FIG. 1, the member 58 is free ended so that it is freely rotatable about the pivot 59.

The procedure for moving the mechanism 10 from the unfolded bed position of FIG. 1 to the folded sofa position of FIG. 4 will now be described with reference first to FIG. 1 and subsequently to FIGS. 2–4 in order. First, the foot section 38 is manually rotated in a clockwise direction until it is folded on top of the intermediate section 36. This movement in itself has no effect on the linkage assembly 32. It should be noted first that the folded position of the foot section 38 is illustrated only in FIG. 3. It has been eliminated from FIGS. 2 and 4 for purposes of clarity. Second, the end of the intermediate section 36 is lifted from its position in FIG. 1 to its position in FIG. 2. During this movement, the head section 34 remains coplanar with the intermediate section 36. However, both sections 34 and 36 are moved from horizontal positions to downwardly and rearwardly inclined positions. Thus, while the end of the intermediate section 36 to which the foot section 38 is attached is raised, the end 37 of the head section 34 is lowered. At the end of this movement, the head section 34 engages the head section control member 58; that is, the side tube 39 is received into the flange portion 62 of the member 58.

Next, the intermediate section 36 is moved to a greater degree of inclination relative to the support member 30 and simultaneously moved rearwardly toward the back frame member 18 of the sofa frame 14. The result of this movement is that the head section 34 and the intermediate section 36 no longer remain coplanar, as seen in solid lines in FIG. 3. Due to the engagement of the side tube 39 with the head section control member 58, the head section 34 is rotated counterclockwise relative to the intermediate section 36 and extends substantially upwardly from the end of the intermediate section 36 to which it is connected. Finally, as seen from a comparison of FIGS. 3 and 4, the intermediate section 36 is pushed simultaneously toward the back frame member 18 of the sofa frame 14 and downwardly toward the support member 30. During this movement, the head section control member 50 continues to engage the head section 34, guiding it upwardly into the vertically elongated section 24 of the storage space 12. As a result of this movement, also, the intermediate section 36 of the bed frame 28 and the elements of the linkage assembly 32 extend substantially parallel to and adjacent the support member 30, so that the mechanism 10 is completely stored within the storage space 12.

In order to move the mechanism 10 from the folded position shown in FIG. 4 to the unfolded position shown in FIG. 1, the movements described above are simply repeated in reverse.

The body member 60 is preferably equipped with a removable and replaceable spacer member 70, as shown in FIG. 6. The spacer 70 has a supporting stem 72 which is frictionally received in an opening 74 in the flange 62. When a spacer 70 is used, the storage position of the head section 34 is adjusted, as shown in broken lines in FIG. 3 to thereby enable adjustment of the mechanism 10 to fit into various frames 14.

It can thus be seen that this invention provides an improved sofa bed mechanism 10 which can be stored within a minimum of space and in a variety of frames 14. The mechanism 10 provides a head section control member 58 which guides movement of the head section 34 of the bed frame 28 so that it can be stored within the vertically elongated storage section 24 of a sofa frame 14. The head section control member 58 is of simple construction, lightweight, inexpensive and easy to install, and controls movement of the head section 34 without any requirement for tubes extending across the bed frame 28 which would interfere with sleeper comfort.

What is claimed is:

1. In a sofa bed including front, back and side frame members which define a storage space which includes a vertically elongated section adjacent said back frame member, a mechanism comprising a foldable bed frame including in succession a head section, an intermediate section and a foot section, said sections being pivotally joined at their ends and movable between a substantially coplanar horizontal bed position and a folded sofa position in which said sections are completely received within said storage space with said head section extending into the vertically elongated portion of said storage space, a support member on which said bed frame is supported and which is adapted to be secured to said sofa bed within said storage space, a linkage assembly on said support member operable to control movement of said bed frame between said bed and sofa positions and a head section control member comprising a free-ended bracket member freely pivotally supported on said linkage assembly and operable to engage said head section during movement of said bed frame toward said sofa position to pivot said head section relative to said intermediate section and guide said head section upwardly into said vertically elongated portion of said storage space.

2. The sofa bed mechanism according to claim 1 wherein said bracket member comprises a generally L-shaped body having a laterally extending flange portion at the lower end thereof engageable with the underside of said head section for supporting said head section and guiding the movement thereof into and out of said vertically elongated portion of said storage space.

3. The sofa bed mechanism according to claim 2 further including a pivot member mounting the upper end of said bracket member body on said linkage for free swinging movement about a substantially horizontal axis.

4. The sofa bed mechanism according to claim 3 further including a spacer member carried by said flange portion of said bracket member body and extending upwardly therefrom into engagement with the underside of said head section.

* * * * *